US008503688B2

(12) United States Patent
DiRusso

(10) Patent No.: US 8,503,688 B2
(45) Date of Patent: Aug. 6, 2013

(54) DEVICE TO ENHANCE AN EAR BUD

(76) Inventor: Gregory DiRusso, Princeton Junction, NJ (US)

( * ) Notice: Subject to any disclaimer, the term of this patent is extended or adjusted under 35 U.S.C. 154(b) by 584 days.

(21) Appl. No.: 12/546,036

(22) Filed: Aug. 24, 2009

(65) Prior Publication Data

US 2011/0044463 A1 Feb. 24, 2011

(51) Int. Cl.
*H04R 1/10* (2006.01)

(52) U.S. Cl.
USPC ..... 381/74; 381/73.1; 381/334; 381/309; 381/189; 455/575.1; 455/90.3

(58) Field of Classification Search
USPC ..... 381/380, 374, 375, 376, 377, 378, 381/379, 372, 370, 371, 385, 390, 395, 74, 381/73.1, 72, 89, 151, 165, 166, 189, 332, 381/334, 339, 345, 354, 367, 373, 382, 384, 381/386, 94.1, 71.6, 71.1, 71.7, 309; 455/569.1, 455/575.1, 575.2, 575.6, 575.8, 90.3
See application file for complete search history.

(56) References Cited

U.S. PATENT DOCUMENTS 4,944,361 A 7/1990 Lindgren et al.
4,965,838 A 10/1990 Kamon et al.
5,117,465 A * 5/1992 MacDonald ..... 381/379
5,343,523 A * 8/1994 Bartlett et al. ..... 379/430
5,835,609 A 11/1998 LeGette et al.
D443,870 S 6/2001 Carpenter et al.
6,391,935 B1 5/2002 Hager et al.
6,449,806 B1 9/2002 Engelhard et al.
7,110,563 B2 9/2006 Bergere
7,116,795 B2 10/2006 Tuason et al.
7,177,433 B2 2/2007 Sibbald
7,248,705 B1 7/2007 Mishan
7,317,802 B2 1/2008 Wurtz
7,367,422 B2 5/2008 Harris, Jr. et al.
7,466,838 B1 12/2008 Moseley
2008/0112586 A1 5/2008 Ito
2008/0144878 A1 6/2008 Oliveira et al.
2008/0226114 A1 9/2008 Thompson et al.
2008/0292111 A1 11/2008 Park
2008/0310666 A1 12/2008 Wengreen
2009/0202098 A1 * 8/2009 Chan et al. ..... 381/380

* cited by examiner

*Primary Examiner* — Vivian Chin
*Assistant Examiner* — Leshui Zhang
(74) *Attorney, Agent, or Firm* — Porzio, Bromberg & Newman, P.C.

(57) ABSTRACT

The present invention relates to a device to enhance an ear bud including a headband coupled to one or more ear pads. The ear pad being formed of a material for providing dampening of ambient sound and physiologic compression. For example, the pad can be formed of a visco-elastic foam having a thickness to provide noise reduction and sufficient comfort by avoiding excessive compression on any one part of the ear. The headband and the ear pad provide a force for compressing the tragus and antitragus to partially isolate the ear bud in the external auditory canal.

6 Claims, 8 Drawing Sheets

DEVICE TO ENHANCE AN EAR BUD

BACKGROUND OF THE INVENTION

1. Field of the Invention

The present invention relates to a device to enhance an ear bud in which the ear listening device is maintained in place and, in some embodiments, includes a small speaker and the device provides noise reduction.

2. Description of Related Art

Ear buds are listening devices designed for placement in the concave portion of the listener's ear or auricle, such as described in U.S. Pat. No. 4,965,838. By design, ear buds are "open air" devices and do not provide isolation from ambient noise to which the listener may be exposed.

Devices for sound isolation are known and are used in many settings including settings where a high degree of isolation from high volume external noise may be desirable. In settings with lower volume external noise, devices that provide lesser degrees of isolation may be desirable. Industrial use devices, typically intended to provide a high level of isolation from surrounding noise, may form a tight seal against the wearers head to isolate the entire ear or form a tight seal within the external auditory canal. Such an approach allows a tight seal between the ear pad and the user's head or between the in-ear device and the external auditory canal, resulting in isolation of the ear drum from surrounding sound and marked and measurable reduction in sound pressure level from ambient sound. U.S. Pat. No. 4,944,361 discloses an acoustic ear muff which includes a pad or cup which is made of rigid material and incorporates an opening for receiving one ear of the wearer. A resilient sealing annulus is intended for abutment with the head of the wearer. The ear muff also includes a resilient pressure-exerting means connected to the shell of a protective helmet, a head strap or like head gear. The ear muff provides good acoustic damping and a high degree of comfort, owing to the fact that the resilient pressure-exerting means is configured to produce a low pressing force substantially independently of head sizes which vary within given limits. This type of industrial device, providing a high degree of sound isolation, may be unnecessary in an environment requiring only a modest amount of sound isolation.

An additional characteristic of ear bud headphones is the typically (or, "commonly") insecure position of the transducer relative to the listener's ear due to features of the devices and users, including light weight and small size of the ear buds as well as variations in ear anatomy among users. This may result in the ear buds falling out of the auricular (or "ear") canal and/or assuming a position that provides suboptimal and inconsistent sound quality. U.S. Patent Application No. 2008/0310666 describes an adaptation device that removably attaches to ear bud style headphone(s) and provides improved security and retention of the ear bud to a wearer's ear yet positions the speaker in substantially the same distance relative to the concha and/or ear canal of a wearer as a wearer would ordinarily wear an ear bud. The adaptation device includes a hook having a frontside portion and a backside portion. The frontside portion of the hook is sized and shaped for positioning the ear bud roughly upside-down relative to a wearer's ear and for positioning the speaker of the ear bud generally over the auditory canal and generally within the concha and/or the auditory canal of the ear. The backside portion of the hook is sized and shaped to hook over the top of the helix to the backside of the wearer's ear along the backside of the auricle. A holding means is used for holding an ear bud headphone by the stem of the ear bud, the holding means located on the frontside of the hook.

U.S. Patent Application Publication No. 2008/0144878 relates to an ear bud adapter which includes an adapter body having a first side, a port or projection extending from the first side, and a second side. The second side is generally configured to be releasably attachable to an ear bud or ear bud-type headphone which would be positioned in the outer ear during use. The projection may include a sleeve attached thereto. The projection or the projection and sleeve are generally configured to extend into the ear canal of a user. A sleeve or foam cover is positioned over the sleeve to provide a contact surface which generally conforms to the user's ear canal shape when at least a portion of the sleeve is positioned therein. The above described ear bud adapters require a specific anatomy which an individual wearer may not exhibit, given the variability of human ear anatomy and none provide sound isolation while providing security of position. Additionally, the adapter has the shortcoming that it attaches to the transducer itself rather than a separate device that is universal for use of all in-ear devices.

Attempts to isolate the sound have focused on electronic noise canceling technologies or sound proofing ear muffs commonly used for hearing protection in industrial and aviation settings. Electronic methods of sound reduction do not isolate the ear from surrounding noise but provide an electronic means to neutralize certain types of external, ambient sound. U.S. Pat. No. 7,177,433 describes a method and apparatus for improving the audibility of sound from a loudspeaker located close to an ear, including the steps of detecting ambient acoustic noise arriving from other sound sources, using a transducer that provides corresponding ambient sound signals, inverting the polarity of the ambient sound signals and combining them with the signals being fed to the loudspeaker to reduce the audibility of the ambient acoustic noise, and passing the ambient sound signals through a filter having a predetermined average transfer function that compensates for the spectral modification of sounds travelling from the loudspeaker to the ear caused by the proximity of the ear of a listener in use. The devices require electronic components with external power, such as from batteries.

It is desirable to provide an improved device to enhance an ear bud by using the natural contours and inherent acoustic properties of the ear to enhance the quality of sound, increase the security of the ear bud's position in the wearer's ear canal and provide isolation from ambient noise that can interfere with delivered audio material.

SUMMARY OF THE INVENTION

The present invention relates to a device to enhance an ear bud including a headband coupled to one or more ear pads. The ear pad being formed of a material for providing dampening of ambient sound and physiologic compression. For example, the pad can be formed of a visco-elastic foam having a thickness to provide noise reduction. The headband and the ear pad provide a force for compressing the tragus and atittragus of the ear to partially isolate the ear bud in the external auditory canal In one embodiment, the headband is adjusted in length to provide sufficient compression to gently compress the ear pad and the ear without delivery excessive pressure that can create "hot spots", painful areas of the ear. The ear pad can have a base that can be fixedly attached to the headband. Alternatively, the base can be coupled to the headband with a movable interface for allowing the base to be moved around the circumference of the headband. In one embodiment, the ear pad includes a speaker which protrudes from each ear pad to provide sound when used without ear buds. Alternatively, the speaker of the ear pad is positioned behind the ear pad.

In one embodiment, the device to enhance an ear bud can be used with an ear bud type telephone headset including a microphone in an ear bud or on a wire that connects to a telephone. The one ear pad can include a speaker, behind the ear pad or protruding from the pad. On the same side of the headband, the microphone can be attached to the outside of the ear pad or it can be mounted on a boom to bring it closer to the user's mouth. In either configuration, the embodiment of the device used as a telephone headset (active) or to enhance a telephone headset (passive), the opposite side of the headband (where there is no ear pad) would have a pad that can anchor the device to the head to allow sufficient pressure on the side of the headband with the ear pad.

The invention will be more fully described by reference to the following drawings.

DETAILED DESCRIPTION

Figure 1:
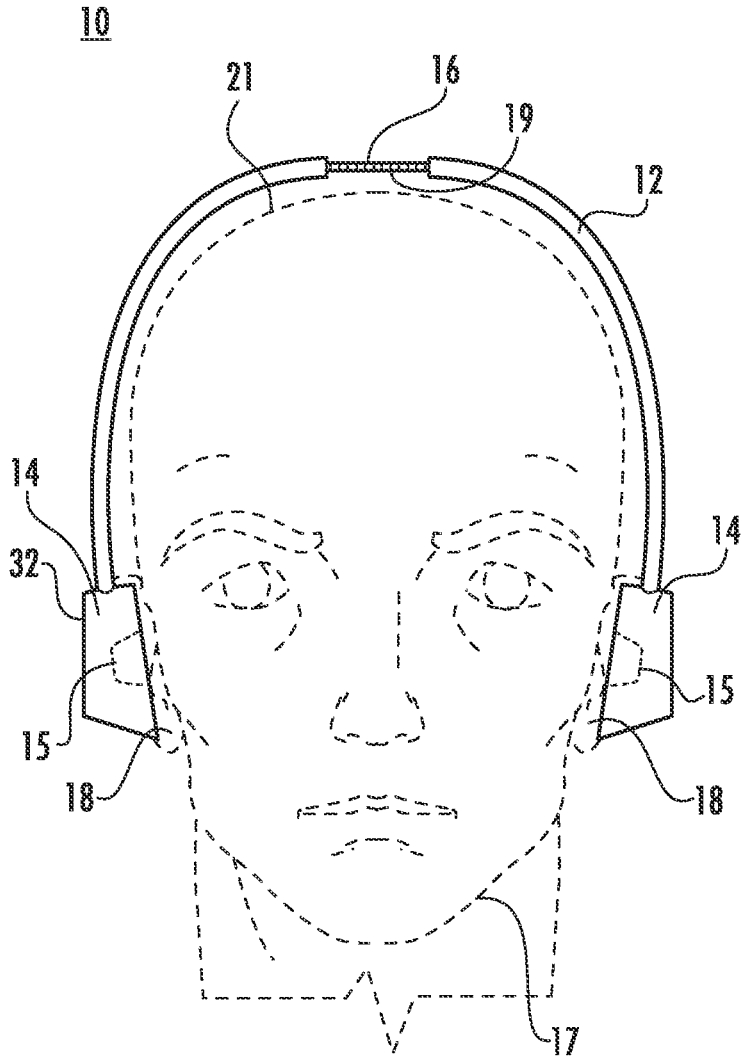
FIG. 1 is a schematic diagram of a device to enhance an ear bud in accordance with the teachings of the present invention.

Reference will now be made in greater detail to a preferred embodiment of the invention, an example of which is illustrated in the accompanying drawings. Wherever possible, the same reference numerals will be used throughout the drawings and the description to refer to the same or like parts.

Figure 2:
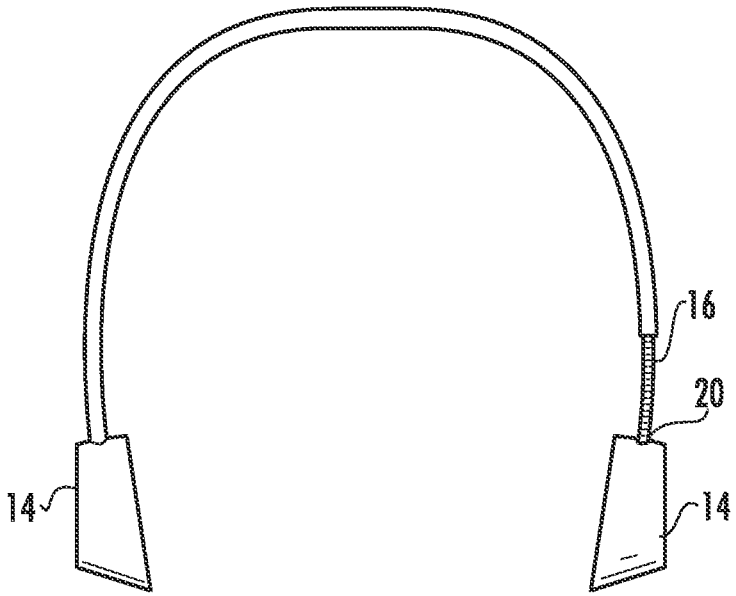
FIG. 2 is a schematic diagram of the device in an alternate embodiment including an adjustment portion at an end of the headband where the ear pad attaches to the headband.

FIG. 1 illustrates device to enhance an ear bud 10 in accordance with the teachings of the present invention. Headband 12 is coupled to one or more ear pads 14. Ear pad 14 is positioned over ear bud 15. Headband 12 can include adjustment portion 16. Adjustment portion 16 allows headband 12 to be adjusted in length to receive a user's head 17. Adjustment portion 16 can be adjusted to provide sufficient compression on user's ear 18 to gently compress ear pad 14 against ear 18. Adjustment portion 16 can be positioned at or near middle portion 19 of headband 12. In an alternate embodiment, adjustment portion 16 can be positioned at or near end portion 20 of headband 12, as shown in FIG. 2.

Figure 3:
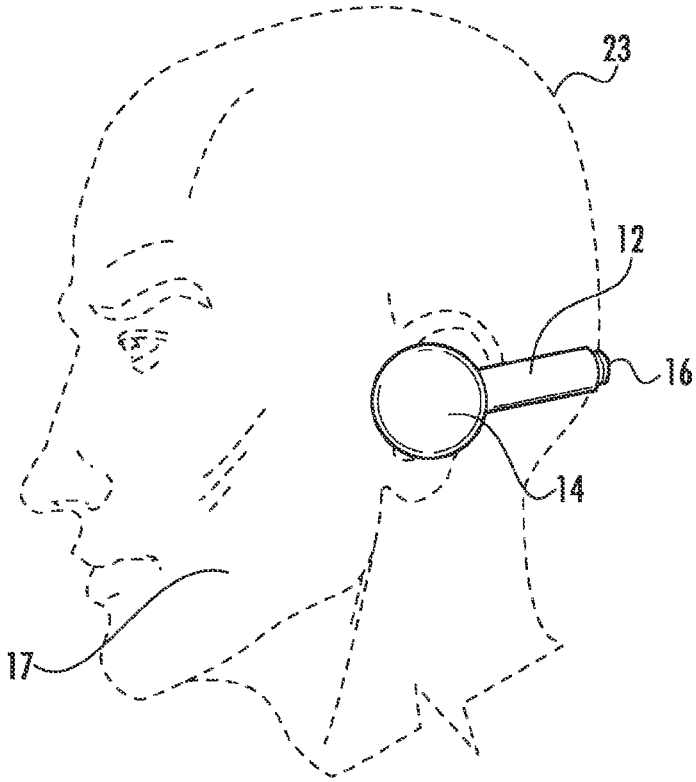
FIG. 3 is a schematic diagram of the device in an alternate embodiment in which the headband is worn around the rear of the head.
Figure 4:
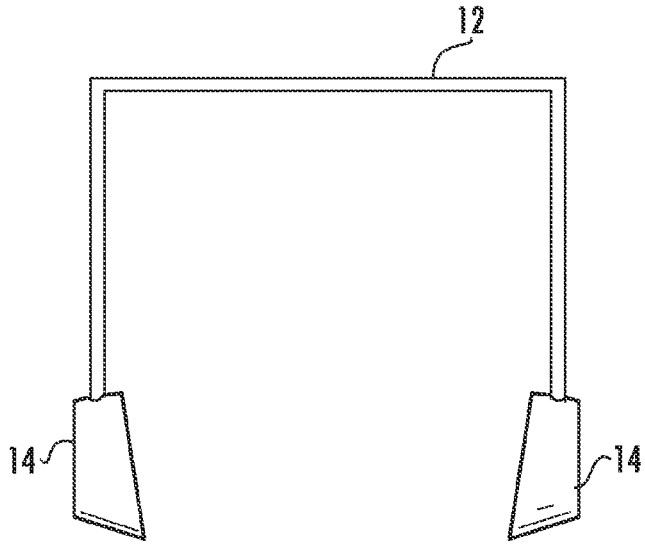
FIG. 4 is a schematic diagram of an alternate embodiment of the device including a headband having a square shape.

Referring to FIG. 1, headband 12 can be worn over top 21 of head 17. Alternatively, headband 12 can be worn around rear 23 of head 17, as shown in FIG. 3. Headband 12 can have a curved shape for following the curved shape of head 17, as shown in FIG. 1. Alternatively, headband 12 can have a square or rectangular shape for applying pressure to ear pad 14, as shown in FIG. 4. It will be appreciated that headband 12 can be any shape that can result in ear pads 14 to apply pressure to both ears. Headband 12 can be formed of a plastic material such as polypropylene to provide pressure to ear pad 14 when headband 12 is expanded over head 17. Adjustment portion 16 can be a telescoping portion for allowing expeditious adjustment.

Figure 5:
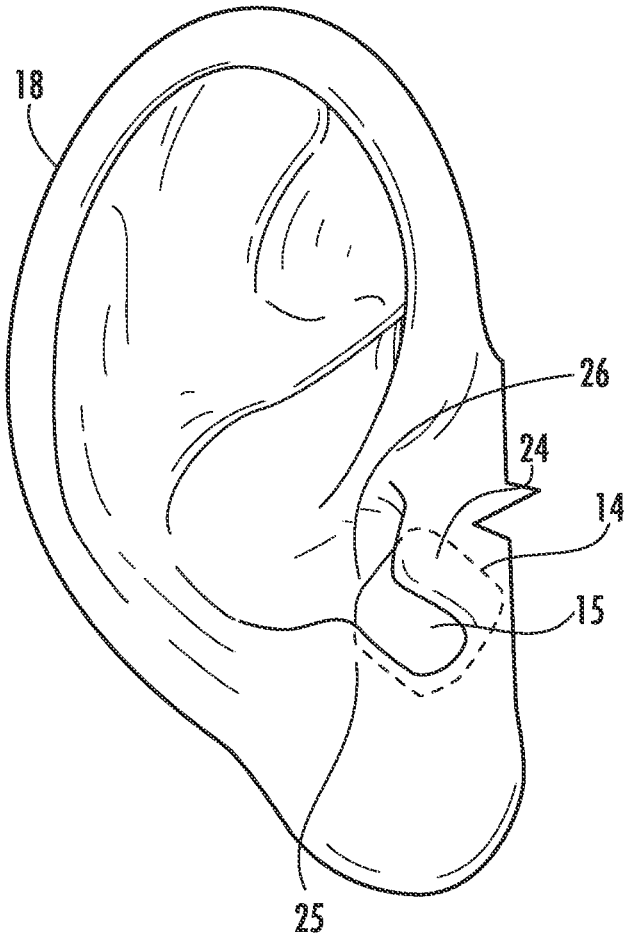
FIG. 5 is a schematic diagram of the ear bud in dashed line during use in the ear.
Figure 6:
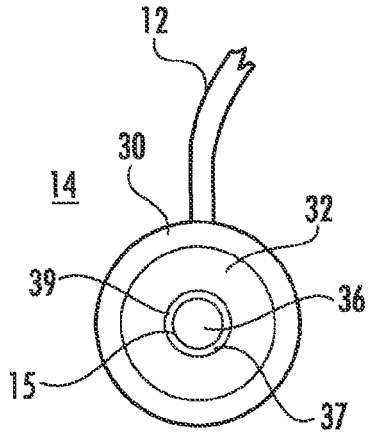
FIG. 6 is a schematic diagram of the ear pad including a base and a pad.

During use, ear pad 14 provides compression of tragus 24 and antitragus 25 of ear 18 creating a partially isolated chamber of external auditory canal 26 in which the ear bud rests, as shown in FIG. 5. Ear pad 14 comprises base 30 and pad 32, as shown in FIG. 6.

Figure 7:
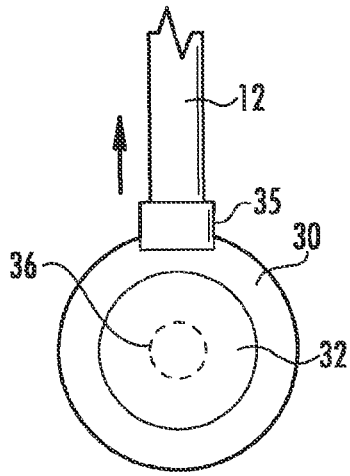
FIG. 7 is a schematic diagram of and alternate embodiment of the ear pad in which the base includes a moveable interface.

Base 30 can be formed of a solid rigid material. A suitable material for base 30 is metal, rigid ABS plastic or nylon. Base 30 can have a thickness to provide suitable support, for example in the range of about 2 mm to about 5 mm depending upon the material from which it is made. Base 30 is coupled to headband 12. Base 30 can be coupled to headband 12 in a fixed arrangement. Alternatively, base 30 can be coupled to headband 12 with movable interface 35 for allowing base 30 to be moved around the circumference of headband 12, as shown in FIG. 7. In this embodiment, headband 12 can be non-adjustable. Alternatively, headband 12 can be adjustable and include adjustment portion 16 as described above.

Pad 32 can have an oval, circular or other shape. Pad 32 can have a diameter in the range of about 1 inch to about 3 inches. Thickness of pad 32 is selected to be adequate to avoid painful compression of portions of ear 18 and provide noise reduction and/or cancellation. Thickness of pad 32 can be increased to provide additional cushioning and provide increased pressure on ear 18 to provide isolation of sound and a sealed environment with ear bud 15. For example, pad 32 can have a thickness in the range of about ⅜ inch to about 1 inch. Pad 32 can be formed of a material for providing dampening of ambient sound and physiologic compression. A suitable material for pad 32 can be visco-elastic foam. In one embodiment, pad 32 is formed of a visco-elastic, high-damping foam, an Indention Force Deflection of 2-5 lbs. as described in U.S. Pat. No. 6,391,935, hereby incorporated by reference herein in its entirety into this application. Ear bud 15 can include speaker 36. Speaker 36 can protrude from pad 32, as shown in FIG. 6. Rim 37 of pad 32 is positioned around speaker 36. Alternatively, speaker 36 is positioned behind pad 32, as shown in FIG. 7. A noise cancelling system 39 can be provided using speaker 36. For example, speaker 36 can generate noise cancelling output. Alternatively, noise cancelling system 39 can be incorporated into ear bud 15 to provide additional noise cancelling, as shown in FIG. 6.

Figure 8:
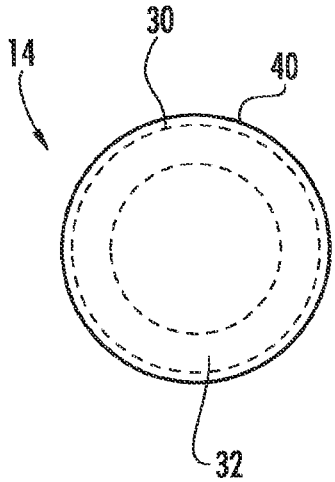
FIG. 8 is a schematic diagram of the ear pad including a cover.

In one embodiment, cover 40 can be used in device 10, as shown in FIG. 8. Ear pad 14 can include cover 40. Cover 40 is removable and is positioned over pad 32 and base 30. Cover 40 can be formed of a washable material. Cover 40 provides protection of pad 32 from oils, dander and other materials that can stain or damage pad 32.

Figure 9:
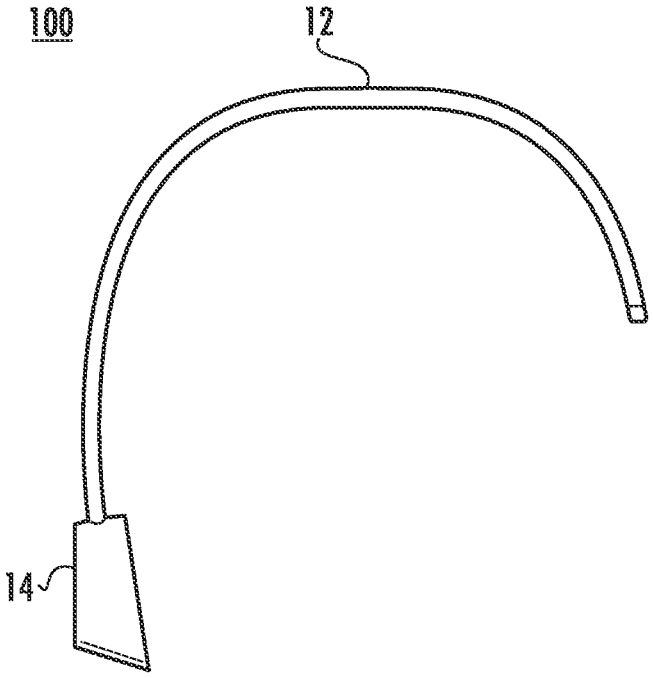
FIG. 9 is a schematic diagram of an alternate embodiment in which only one ear pad is attached to the headband.

In one embodiment, device to enhance ear bud 100 includes headband 12 coupled to one ear pad 14, as shown in FIG. 9.

Figure 10:
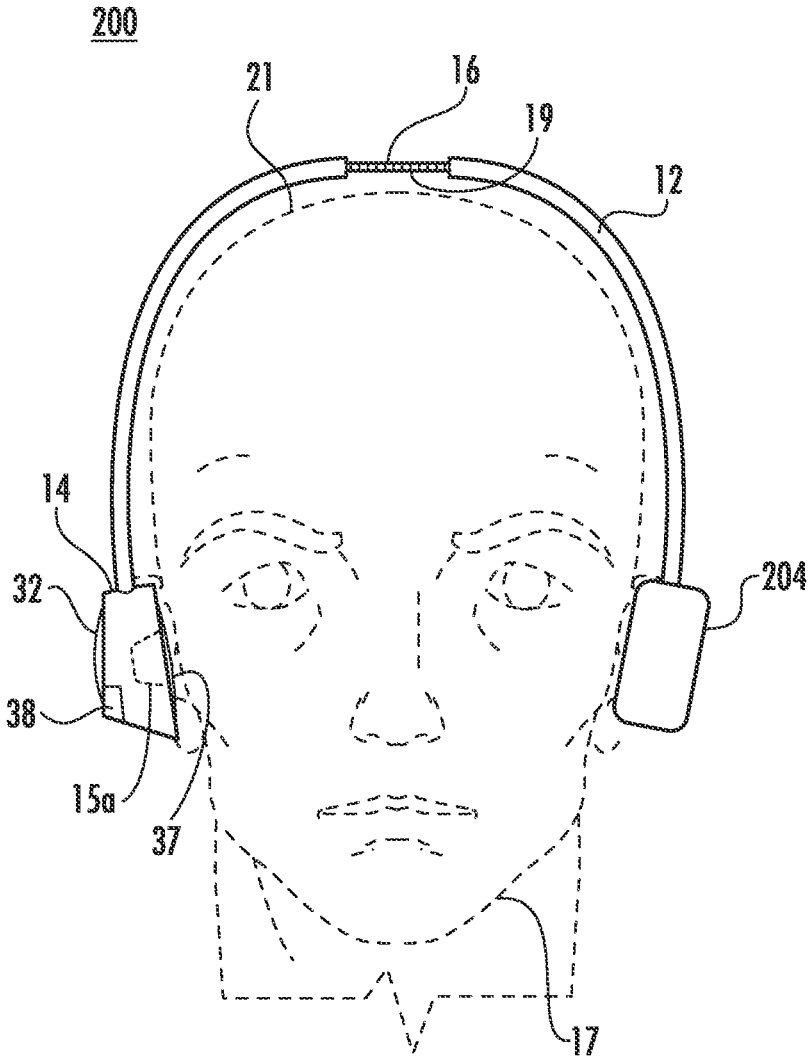
FIG. 10 is an alternate embodiment in which the device includes a speaker in one ear bud and a microphone in a second ear bud.
Figure 11:
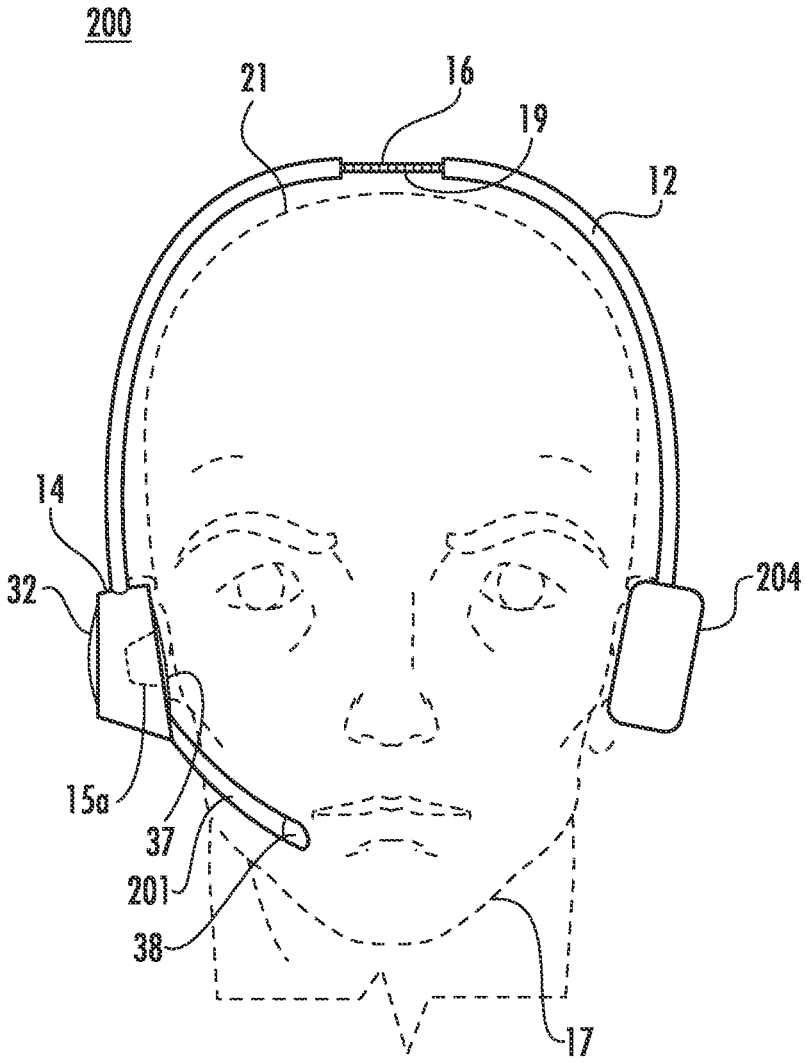
FIG. 11 is an alternate embodiment in which the device includes a microphone for use as a telephone headset.

In one embodiment, device 200 includes speaker 37 incorporated into ear bud 15*a* pad 32 and a microphone 38 mounted on ear pad 14, as shown in FIG. 10. Alternatively, microphone 38 can be mounted on boom 201 from headband 12 on the side of ear bud 15 extending for use as a telephone headset, as shown in FIG. 11. In this embodiment, pad 32 is positioned over ear bud 15*a*. Pad 204 is attached on the opposite side of headband 12 to anchor headband 12 to head 17. Alternatively, microphone 38 can be mounted in a wire of a telephone headset (not shown). In one embodiment, the device can be used with an ear bud type telephone headset that has the microphone in the ear bud or on the wire that connects to the telephone. In the active configuration, the device can have one ear pad. The one ear pad would have one speaker behind the pad or protruding from the pad. On the same side of the headband, a microphone can be attached to the outside of the ear pad or it could be mounted on a boom to bring it closer to the user's mouth. In either configuration (active or passive), the device of the present invention is used as a telephone headset or to enhance a telephone headset, the opposite side of the headband (where there is no ear pad) can have a pad that anchors it to the head.

It is to be understood that the above-described embodiments are illustrative of only a few of the many possible specific embodiments, which can represent applications of the principles of the invention. Numerous and varied other arrangements can be readily devised in accordance with these principles by those skilled in the art without departing from the spirit and scope of the invention.

What is claimed is:

1. A device to enhance noise reduction and to receive an ear bud, and said ear bud including a speaker, comprising:

a headband coupled to one or more ear pads, said one or more ear pads being formed of a visco-elastic foam providing sound absorption and noise reduction to the received ear bud, said one or more ear pads including a rim and said rim of said one or more ear pads is adapted to receive said ear bud and said rim is positioned around the received said ear bud to allow the received said ear bud including said speaker to protrude from said one or more ear pads;

a base, said base being attached to said one or more ear pads and said base being coupled to said headband, and wherein said base compresses said one or more ear pads and said one or more ear pads are adapted to cover the external surface of the tragus and antitragus for compression of the tragus and antitragus of the ear and to create a partially isolated chamber of the external auditory canal in which the received said ear bud rests.

2. The device of claim 1 wherein said base is coupled to said headband with a movable interface for allowing said base to move around the circumference of said headband.

3. The device of claim 1 wherein said headband is adapted to be positioned around the rear of a head of a user of the device.

4. The device of claim 1 wherein said base is formed of a rigid material selected from metal, rigid ABS plastic or nylon.

5. The device of claim 1 further comprising a cover, said cover covering said ear pad.

6. The device of claim 5 wherein said cover is removable and is made of a washable material.

* * * * *